US008047767B2

(12) United States Patent
Montgomery

(10) Patent No.: US 8,047,767 B2
(45) Date of Patent: Nov. 1, 2011

(54) HIGH PRESSURE FIRST STAGE TURBINE AND SEAL ASSEMBLY

(75) Inventor: Michael Earl Montgomery, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/237,230

(22) Filed: Sep. 28, 2005

(65) Prior Publication Data

US 2007/0071597 A1 Mar. 29, 2007

(51) Int. Cl.
*F01D 11/02* (2006.01)
*F01D 11/00* (2006.01)

(52) U.S. Cl. ..... 415/101; 415/106; 415/111; 415/115; 415/174.2; 415/174.4; 415/174.5; 415/230; 415/231

(58) Field of Classification Search ..... 415/101–103, 415/106, 111, 112, 113, 115–117, 174.2, 415/174.4, 174.5, 230–231
See application file for complete search history.

(56) References Cited

U.S. PATENT DOCUMENTS 3,429,557 A * 2/1969 Brandon et al. ..... 415/174.5
3,501,246 A * 3/1970 Hickey ..... 415/174.2
3,817,654 A 6/1974 Sohma
4,767,267 A 8/1988 Salt et al.
5,125,794 A * 6/1992 Detanne ..... 415/115
5,205,706 A 4/1993 Belcher
5,328,326 A * 7/1994 Gros et al. ..... 415/115
5,411,365 A 5/1995 Mazzola et al.
5,601,403 A 2/1997 Galbraith et al.
5,913,812 A 6/1999 Smith et al.
5,997,249 A 12/1999 Bell
6,168,377 B1 * 1/2001 Wolfe et al. ..... 415/174.2
6,345,952 B1 * 2/2002 Oeynhausen et al. ..... 415/103
6,431,827 B1 * 8/2002 Wolfe et al. ..... 415/173.3
6,517,314 B1 * 2/2003 Burnett et al. ..... 415/173.7
6,589,012 B2 * 7/2003 Burnett et al. ..... 415/174.2
6,676,369 B2 1/2004 Brauer et al.
6,722,850 B2 * 4/2004 Burdgick ..... 415/230
6,761,530 B1 * 7/2004 Ginessin et al. ..... 415/174.5
6,776,577 B1 8/2004 Chu et al.
6,896,482 B2 * 5/2005 Parry ..... 415/231

* cited by examiner

*Primary Examiner* — Christopher Verdier
(74) *Attorney, Agent, or Firm* — Armstrong Teasdale LLP

(57) ABSTRACT

A high pressure first stage turbine and seal assembly are described. In one embodiment, a high pressure turbine section is provided. The turbine section includes at least one stage, at least one rotor and a bucket assembly. The bucket assembly includes a bucket and an attachment fixture. The stage has a high root reaction during operation. An intermediate space is between the bucket assembly and a stationary component of the turbine section. A seal is provided between the stationary member and the rotor to facilitate preventing leakage from the intermediate space toward an end of the stage. Steam balance holes are provided in the rotor or the bucket to facilitate feeding steam towards an end of the turbine stage.

15 Claims, 2 Drawing Sheets

HIGH PRESSURE FIRST STAGE TURBINE AND SEAL ASSEMBLY

BACKGROUND OF THE INVENTION

The present invention relates generally to rotary machines and, more particularly, to a high pressure first stage turbine.

At least some steam turbines have a defined steam path which includes, in serial-flow relationship, a steam inlet, a turbine, and a steam outlet. Steam leakage, either out of the steam path or into the steam path, from an area of higher pressure to an area of lower pressure may adversely affect an operating efficiency of the turbine. For example, steam-path leakage in the turbine between a rotating rotor shaft of the turbine and a circumferentially surrounding turbine casing, may lower the efficiency of the turbine.

To facilitate minimizing steam-path leakage to the atmosphere, at least some known steam turbines use a packing casing that includes a plurality of labyrinth seals. Some known labyrinth seals include longitudinally spaced-apart rows of labyrinth seal teeth which are used to seal against pressure differentials that may be present in the steam turbine. Seal members, such as brush seals or leaf seals, may also be used in an attempt to reduce leakage through a gap defined between two components.

In an attempt to reduce leakage of steam from the root of the stage into the end of the section, low reaction roots have been used. Generally, a low reaction root causes the leakage steam at the root to be at a reduced pressure as compared to the main flow pressure. Negative reaction and steam balance holes induce steam from the discharge of the stage through the steam balance holes to feed the leakage path. As a result, most of the steam that leaks has already been expanded through the stage and produced useful work. Such low reaction roots, however, may result in less efficient expansion of the steam than high reaction roots. A high degree of reaction facilitates ensuring there is a positive pressure on the rotating blade at all diameters, which in turn facilitates efficient expansion of the steam.

Another known approach is to use steam from a space between a nozzle and a bucket to feed the leakage path. The leakage path through the end section is decreased because the nozzle decreases the steam pressure, thus decreasing the source pressure for the leakage path. However, none of the steam used to feed the leakage path expands through the bucket to produce useful work. In addition, in-service variations of the reaction of the stage due to wear and tear may impact other machine parameters in a disadvantageous manner.

Yet another known approach utilizes high reaction stage roots with the leakage flow fed from the bowl of the stage. However, the bowl pressure is higher than the intermediate pressure at the roots. As a result, the source pressure for the leakage flow is higher and the leakage flow will increase, which leads to decreased efficiency.

BRIEF DESCRIPTION OF THE INVENTION

In one aspect, a high pressure turbine section is provided. The turbine section includes at least one stage, at least one a rotor, a nozzle, and a bucket assembly. The bucket assembly includes a bucket and an attachment fixture. The stage has a high root reaction during operation. An intermediate space is between the bucket assembly and a stationary component of the turbine section. A seal is provided between the stationary member and the rotor to facilitate preventing leakage from the intermediate space toward an end of the section.

In another aspect, a seal assembly for a turbine section is provided. The turbine section includes an intermediate space between a bucket assembly, a stationary member and a rotor. The seal assembly includes a seal between the stationary member and the rotor to facilitate preventing leakage from the intermediate space toward an end of the turbine section, and wheel steam balance holes providing a path for shell steam to feed the section end.

In yet another aspect, a rotary machine is provided. The rotary machine includes at least one stage, at least one rotor, a nozzle, and a bucket assembly. The bucket assembly includes a bucket and an attachment fixture. The stage of the rotary machine has a high root reaction during operation. An intermediate space is between the bucket assembly and a stationary component of the turbine section, and a seal is between the stationary member and the rotor to facilitate preventing leakage from the intermediate space toward an end of the section.

DETAILED DESCRIPTION OF THE INVENTION

Figure 1:
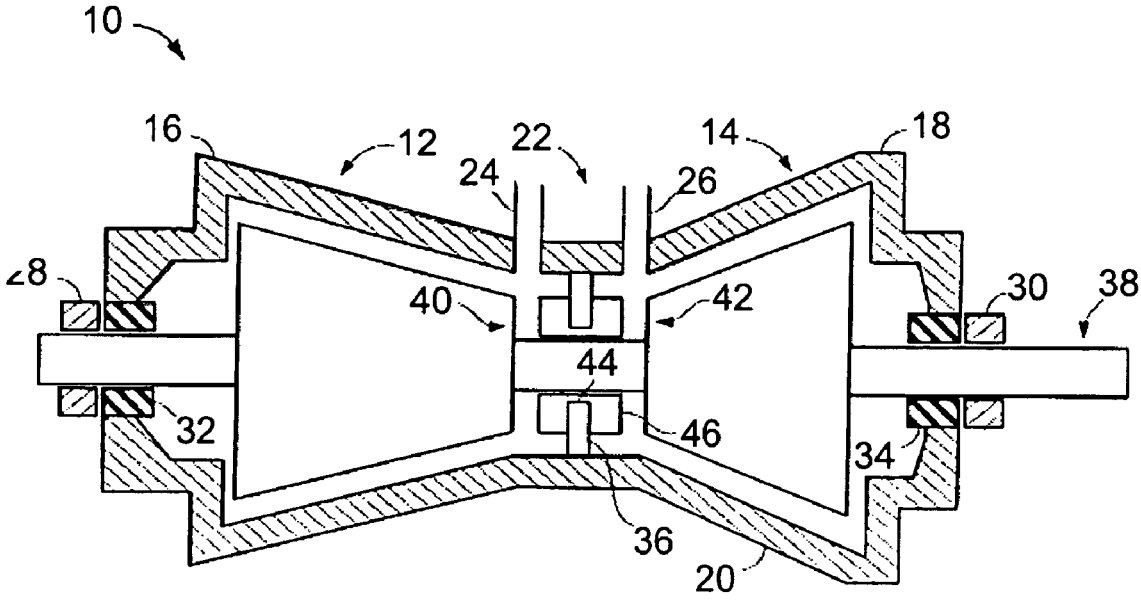
FIG. 1 is a schematic illustration of an exemplary opposed flow High Pressure (HP)/Intermediate Pressure (IP) steam turbine.

FIG. 1 is a schematic illustration of an exemplary opposed-flow steam turbine 10 including a high pressure (HP) section 12 and an intermediate pressure (IP) section 14. Turbine 10 is shown by way of example only. The present invention can be utilized in connection with many different types of high pressure turbine configurations, and is not limited to practice with any one particular type of high pressure turbine.

With respect to turbine 10, an outer shell or casing 16 is divided axially into upper and lower half sections 18 and 20, respectively, and spans both HP section 12 and IP section 14. A central section 22 of shell 16 includes a high pressure steam inlet 24 and an intermediate pressure steam inlet 26. Within casing 16, HP section 12 and IP section 14 are arranged in a single bearing span supported by journal bearings 28 and 30. A steam seal unit 32 and 34 is located inboard of each journal bearing 28 and 30, respectively.

An annular section divider 36 extends radially inwardly from central section 22 towards a rotor shaft 38 that extends between HP section 12 and IP section 14. More specifically, divider 36 extends circumferentially around a portion of rotor shaft 38 between a first HP section nozzle 40 and a first IP section nozzle 42. Divider 36 is received in a channel 44 defined in packing casing 46. More specifically, channel 44 is a C-shaped channel that extends radially into packing casing 46 and around an outer circumference of packing casing 46, such that a center opening of channel 44 faces radially outwardly.

During operation, high pressure steam inlet 24 receives high pressure/high temperature steam from a steam source, for example, a power boiler (not shown). Steam is routed through HP section 12 wherein work is extracted from the steam to rotate rotor shaft 38. The steam exits HP section 12 and is returned to the boiler wherein it is reheated. Reheated steam is then routed to intermediate pressure steam inlet 26 and returned to IP section 14 at a reduced pressure than steam entering HP section 12, but at a temperature that is approximately equal to the temperature of steam entering HP section 12. Accordingly, an operating pressure within HP section 12 is higher than an operating pressure within IP section 14, such that steam within HP section 12 tends to flow towards IP section 14 through leakage paths that may develop between HP section 12 and IP section 14. One such leakage path may be defined extending through packing casing 46 within rotor shaft 38.

Again, steam turbine 10 is illustrated and described herein by way of example only. The present invention can be utilized in connection with many different types of high pressure turbine configurations, and is not limited to practice with any one particular type of high pressure turbine.

Figure 2:
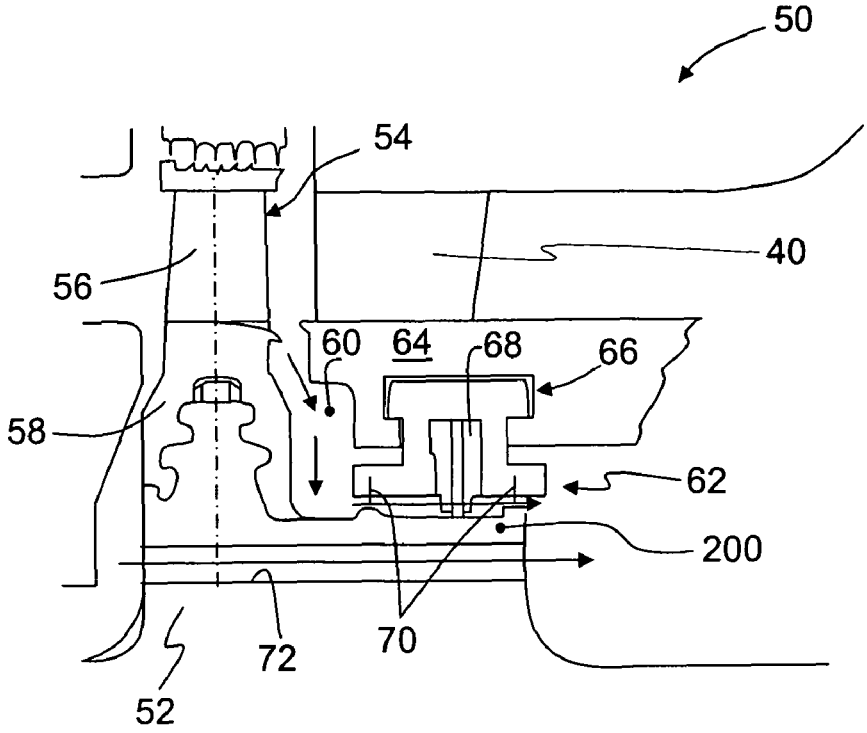
FIG. 2 is a schematic illustration of a portion of a high pressure turbine section.

FIG. 2 is a schematic illustration of a portion of a high pressure stage 50. High pressure stage 50 includes a rotor 52 having a bucket assembly 54 secured thereto, and nozzle 40 (shown in FIG. 1). Bucket assembly 54 includes a bucket 56 secured to an attachment fixture 58. In the exemplary embodiment, attachment fixture 58 is a dovetail. As illustrated in FIG. 2, high pressure stage 50 has a high root reaction. A high root reaction can be characterized as any reaction greater than about 0% and less than about 40%. For example, in one embodiment, stage 50 has a high root reaction of about 25% at about 2214 psia. As is known in the art, the root reaction of any stage is established by the design of the stationary and rotating vanes in that region. Such high root reaction facilitates ensuring there is a positive pressure on rotating bucket or blade 56 at all diameters, which in turn facilitates efficient expansion of the steam. Such efficient expansion of the steam facilitates generation of more useful work. However, the pressure between nozzle 40 and bucket 56 is higher than in a lower reaction configuration. As a result, leakage from an intermediate space 60 may increase.

In order to facilitate reduced leakage as compared to known configurations, and in one embodiment, a sealing arrangement or assembly 62 is utilized. Specifically, a root platform 200 forms a partial seal of intermediate space 60. Intermediate space 60 is defined, in part, by attachment fixture 58 and a stationary member 64. A mating stationary seal 66 also is used to partially seal intermediate space 60. In the embodiment illustrated in FIG. 2, stationary seal 66 is shown in the form of a brush seal 68 with conventional teeth 70. Brush seal 68 facilitates minimizing an amount of steam that leaks from intermediate space 60 to an end of stage 50.

In addition, wheel steam balance holes 72 provide a path for shell steam to feed the stage end. Balance holes 72 are sized, in the example embodiment, to be as small as possible yet sufficiently large enough to provide leakage steam from downstream of the bucket.

Sealing arrangement 62 provides that most leakage flow expands through bucket 56 thereby producing useful work prior to leaking to an end of stage 50. In addition, the source pressure driving the leakage will be lower since it will be closer to the shell pressure and lower than the bowl or intermediate pressure. This lower source pressure will also decrease the leakage.

Further, a highly effective seal at the bowl to the end of stage 50 facilitates minimizing leakage from stage 50. The seal can, for example, be in the form of a packing ring, a seal brush, a leaf seal, a variable clearance seal, or any other highly effective seal that facilitates minimizing leakage from stage 50, as described herein.

Figure 3:
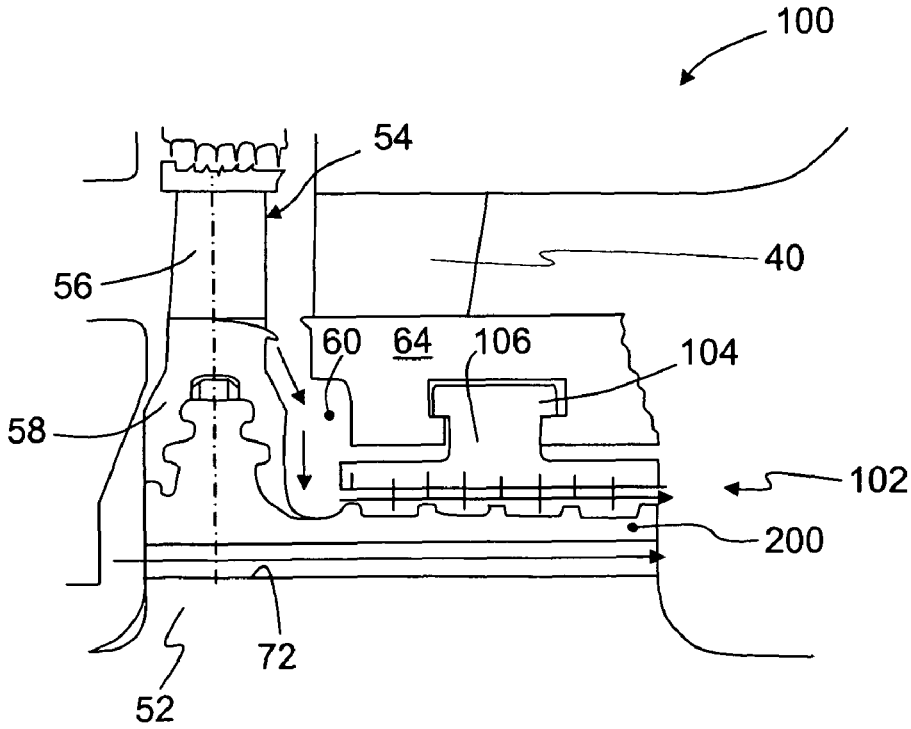
FIG. 3 is a schematic illustration of a portion of an alternative high pressure turbine section.

FIG. 3 is a schematic illustration of an alternative embodiment of a portion of a high pressure stage 100. Components in FIG. 3 that are identical to components in FIG. 2 are referenced in FIG. 3 using the same reference numerals as in FIG. 2. Specifically, high pressure stage 100 includes rotor 52 having bucket 56 secured to attachment fixture 58. As illustrated in FIG. 3, there is a high root reaction that facilitates ensuring there is a positive pressure on rotating bucket or blade 56 at all diameters, which in turn facilitates efficient expansion of the steam.

In the embodiment illustrated in FIG. 3, a sealing arrangement or assembly 102 is utilized. Specifically, root platform 200 forms a partial seal of intermediate space 60. A mating stationary seal 104 also is used to partially seal intermediate space 60. In the embodiment illustrated in FIG. 3, a packing ring seal 106 is shown. Packing ring seal 106 facilitates minimizing an amount of steam that leaks from intermediate space 60 to an end of stage 100. In addition, steam balance holes 72 provide a path for shell steam to feed the stage end.

Sealing arrangement 102 provides that most leakage flow expands through bucket 56 thereby producing useful work prior to leaking. In addition, the source pressure driving the leakage will be lower since it will be closer to shell pressure and lower than the bowl or intermediate pressure. This lower source pressure will also decrease the leakage.

Exemplary embodiments of seal arrangements are described above in detail. The methods, apparatus and systems are not limited to the specific embodiments described herein nor to the specific seal arrangements assembled, but rather, the seal arrangements may be utilized independently and separately from other methods, apparatus, stages, and systems described herein or to assemble seal arrangements not described herein. For example, other seal arrangements can also be assembled using the methods described herein.

While the invention has been described in terms of various specific embodiments, those skilled in the art will recognize that the invention can be practiced with modification within the spirit and scope of the claims.

What is claimed is:

1. A high pressure turbine section comprising:

a rotor extending through said high pressure turbine section; and at least one stage having a high root reaction greater than about 0% and less than about 40% during operation, said at least one stage comprising:

an end;

a bucket assembly coupled to said rotor, said bucket assembly comprising a bucket and a root platform extending upstream from said bucket;

a stationary component positioned upstream from said bucket assembly and adjacent to said end of said at least one stage such that an intermediate space is defined between said bucket assembly and said stationary component;

a plurality of wheel steam balance holes extending through said root platform and beneath said bucket, said plurality of wheel steam balance holes configured to provide a path for shell steam from a cavity defined downstream from said bucket towards a bowl formed at said end of said at least one stage;

a first seal coupled to said stationary component; and a second seal defined within said root platform, said first seal and said second seal interconnect to facilitate reducing leakage from said intermediate space toward said end of said at least one stage, wherein said high pressure turbine section channels steam towards said bucket such that a portion of the steam is channeled across said bucket in a first direction, and a portion of the steam is channeled through said first seal and said second seal in a second direction that is opposite the first direction, wherein a portion of the steam channeled across said bucket is channeled through said plurality of wheel steam balance holes in the second direction.

2. A high pressure turbine section in accordance with claim 1 wherein the root reaction of said at least one stage is about 25% at about 2214 psia.

3. A high pressure turbine section in accordance with claim 1 wherein said first seal comprises a brush seal.

4. A high pressure turbine section in accordance with claim 1 further comprising a highly effective seal coupled to said bowl at said end of said at least one stage, said highly effective seal comprising one of a packing ring, a brush seal, a leaf seal, and a variable clearance seal to facilitate minimizing leakage from said at least one stage.

5. A high pressure turbine section in accordance with claim 1 wherein said first seal comprises a packing ring seal.

6. A seal assembly for a turbine stage in a high pressure turbine section, the turbine stage having a high root reaction greater than about 0% and less than about 40% during operation and including an intermediate space defined between a bucket assembly and a stationary member adjacent to an end of the turbine stage, said seal assembly comprising:

a first seal defined within a root platform of the bucket assembly;

a second seal coupled to the stationary member and configured to contact said first seal to facilitate reducing leakage from the intermediate space toward the end of the turbine stage; and a plurality of wheel steam balance holes extending through said root platform, said holes beneath said bucket assembly, said plurality of wheel steam balance holes providing a path for shell steam from a cavity defined downstream from the bucket assembly towards a bowl formed at the end of the turbine stage to feed the end of the turbine stage, wherein said seal assembly channels steam towards the bucket assembly such that a portion of the steam is channeled across the bucket assembly in a first direction, and a portion of the steam is channeled through said first seal and said second seal in a second direction that is opposite the first direction, wherein a portion of the steam channeled across the bucket assembly is channeled through said plurality of wheel steam balance holes in the second direction.

7. A seal assembly in accordance with claim 6 wherein said second seal comprises a brush seal.

8. A seal assembly in accordance with claim 6 wherein said second seal comprises a packing ring seal.

9. A seal assembly in accordance with claim 6 further comprises a highly effective seal coupled to the bowl at the end of the turbine stage, said highly effective seal comprises one of a packing ring, a brush seal, a leaf seal, and a variable clearance seal to facilitate minimizing leakage from the turbine stage.

10. A seal assembly in accordance with claim 6 where the bucket assembly comprises a bucket and the root platform, the turbine stage providing a high root reaction of about 25% at about 2214 psia during operation.

11. A rotary machine comprising:

a high pressure section; and at least one rotor extending through said high pressure section, wherein said high pressure section comprises at least one stage having a high root reaction greater than about 0% and less than about 40% during operation, said at least one stage comprising:

an end;

a bucket assembly coupled to said rotor, said bucket assembly comprising a platform extending radially outward from said rotor substantially towards said end of said at least one stage such that an intermediate space is defined between said bucket assembly and a stationary component of said rotary machine, said stationary component is positioned adjacent to said end of said at least one stage;

a seal assembly coupled between said stationary component and said bucket assembly to facilitate reducing leakage from said intermediate space toward said end of said at least one stage, said seal assembly comprises a first seal coupled to said stationary component and a second seal defined within said platform; and a plurality of wheel steam balance holes extending through said platform and beneath said bucket assembly, said plurality of wheel steam balance holes configured to provide a path for shell steam from a cavity defined downstream from said bucket assembly towards a bowl formed at said end of said at least one stage to feed said end of said at least one stage, wherein said at least one stage channels steam towards said bucket assembly such that a portion of the steam is channeled across said bucket assembly in a first direction, and a portion of the steam is channeled through said first seal and said second seal in a second direction that is opposite the first direction, wherein a portion of the steam channeled across said bucket assembly is channeled through said plurality of wheel steam balance holes in the second direction.

12. A rotary machine in accordance with claim 11 wherein the root reaction of said at least one stage is about 25% at about 2214 psia.

13. A rotary machine in accordance with claim 11 wherein said first seal comprises a brush seal.

14. A rotary machine in accordance with claim 11 wherein said first seal comprises a packing ring seal.

15. A rotary machine in accordance with claim 11 further comprises a highly effective seal coupled to said bowl at said end of said at least one stage to facilitate minimizing leakage from said at least one stage, said highly effective seal comprising one of a packing ring, a brush seal, a leaf seal, and a variable clearance seal.

* * * * *